United States Patent [19]

Potapov et al.

[11] 4,150,180

[45] Apr. 17, 1979

[54] METHOD FOR CHEMICAL NICKEL-PLATING OF PARTS HAVING A CATALYTIC SURFACE EMPLOYING A VESSEL HAVING AN UPPER HEATED ZONE AND A LOWER COOLED ZONE

[76] Inventors: Fedor P. Potapov, ulitsa Shelkovichnaya, 182, kv. 52; Alexei K. Zorin, ulitsa Chapaeva, 72/24, kv. 15; Jury N. Sulie, ulitsa Sovetskaya, 63, kv. 9; Anatoly I. Artemov, ulitsa Sevrina, 6/12, kv. 89; Alexandr K. Kolchevsky, ulitsa Shelkovichnaya, 181, kv. 19; Tamara P. Lavrischeva, ulitsa Sovetskaya, 21, kv. 66; Naum G. Lyandres, ulitsa Ordzhonikidze, 2, kv. 1; Lilia A. Toltinova, prospekt Entuziastov, 3a, kv. 40; Mikhail J. Murylev, doma 8 Marta, 4, kv. 29, all of Saratov, U.S.S.R.

[21] Appl. No.: 832,346

[22] Filed: Sep. 12, 1977

Related U.S. Application Data

[63] Continuation of Ser. No. 638,860, Dec. 8, 1975, abandoned.

[51] Int. Cl.[2] ..... C23C 3/02

[52] U.S. Cl. ..... 427/430 A; 106/1.27; 118/429; 427/305; 427/319; 427/328; 427/438

[58] Field of Search ..... 427/438, 345, 319, 328, 427/305, 430 A; 118/429; 106/1.27

[56] References Cited

U.S. PATENT DOCUMENTS

| | | | |
|---|---|---|---|
| 2,791,516 | 5/1957 | Chambers et al. | 427/438 |
| 2,822,294 | 2/1958 | Gutzeit et al. | 427/438 |
| 2,955,959 | 10/1960 | DuRose | 427/438 |
| 3,247,013 | 4/1966 | Spraul et al. | 427/438 |
| 3,325,297 | 6/1967 | Talney et al. | 427/438 |
| 3,372,037 | 3/1968 | McGrath et al. | 427/438 |
| 3,556,839 | 1/1971 | Roy | 118/429 |
| 3,727,680 | 4/1973 | Henry | 118/429 |
| 3,853,094 | 12/1974 | Christini et al. | 118/429 |
| 3,876,434 | 4/1975 | Dutkewych et al. | 427/345 |

*Primary Examiner*—John D. Smith

*Attorney, Agent, or Firm*—Lackenbach, Lilling & Siegel

[57] ABSTRACT

According to the proposed method, the upper layer of the working solution is heated and components restoring its concentration are added thereto, while the lower layer of the solution is simultaneously cooled and a reagent restoring the pH of the solution is added thereto. The installation for realizing said method comprises a bath composed of two communicating vessels mounted one atop the other. The lower vessel is provided with an arrangement for cooling the solution therein and with a device for feeding thereinto the reagent restoring the pH of the solution, whereas the upper vessel is provided with an arrangement for heating the solution therein and with a device for feeding thereinto the components restoring the concentration of the solution.

3 Claims, 4 Drawing Figures

METHOD FOR CHEMICAL NICKEL-PLATING OF PARTS HAVING A CATALYTIC SURFACE EMPLOYING A VESSEL HAVING AN UPPER HEATED ZONE AND A LOWER COOLED ZONE

This is a continuation of application Ser. No. 638,860 filed Dec. 8, 1975, now abandoned.

The present invention relates to methods for chemical nickel-plating parts having a catalytic surface and to installations for realizing same which are employed in mechanical engineering and instrument making.

It is currently known in the art to employ a method for chemical nickel-plating parts having a catalytic surface made e.g. of a metal selected from the group which consists of iron, nickel, aluminum, titanium or copper-base alloys.

Said method is based on repeated use of solutions containing components required to effect nickel deposition on the catalytic surface of the parts being nickel-plated.

These components include nickel salts, hypophosphites, a complexing agent, a buffer dopant, an accelerator and a stabilizer. The hypophosphites serve to reduce the ions of nickel to metallic nickel coating the surface of the part being nickel-plated. The most widely used complexing agents are lactic, malic, succinic and citric acids which form a complex with nickel ions. The buffer dopant is constituted by sodium acetate, succinates etc., which stabilize the pH of the solution.

The accelerator is propionic acid or amino acids which speed up the rate of nickel deposition on the surface of the parts being nickel-plated. The stabilizers which prevent spontaneous breakdown of the solution are ions of heavy metals, e.g. $Pb^{++}$, $Hg^{++}$ or $Cd^{++}$.

The solution containing said components is heated to a temperature exceeding 60° C. but below its boiling point. Then the parts to be nickel-plated are immersed in the solution, kept there for a time depending on the desired thickness of the nickel layer, and then withdrawn from the solution.

As the parts are immersed in said solution heated to said temperature, the anions of hypophosphoric acid reduce the nickel ions to metallic nickel on the catalytic surface, the reaction proceeding by the following route:

$$Ni^{++}+H_2PO_2^-+H_2O \rightarrow Ni+H_2PO_3^-+H_2+P+H^+.$$

The rate of this reaction, and hence the speed with which the nickel layer is built up on the catalytic surface, depends on the rate of oxidation of the anion of hypophosphoric acid to the anion of phosphorous acid, said rate rising exponentially with temperature. For most acid solutions, the chemical nickel-plating temperature range lies between 60 and 95° C.

The process of chemical nickel-plating of parts in a solution proceeds by way of said reaction wherein the nickel ions are reduced to metallic nickel deposited on the surface of the parts and removed from the solution therewith, so that the concentration of nickel ions in the solution diminishes.

Simultaneously the concentration of hypophosphoric acid anions in the solution decreases, whereas the concentration of phosphorous acid anions and $H^+$ increases, acidifying the solution.

In order to restore the concentration and acidity of the solution, appropriate reagents are added thereto. Thus, for instance, to restore the concentration of nickel ions and hypophosphoric acid anions, concentrated solutions of nickel sulphate and sodium hypophosphite, respectively, are added to the solution.

The proper acidity of the chemical nickel-plating solution is restored by adding thereto a dilute alkali or ammonia solution. These alkalizing agents are added to the solution maintained at a temperature of not greater than 50° C. At which no solid particles of slightly soluble nickel hydroxide are formed.

Since the foregoing reaction is autocatalytic, a nickel layer will be built up on any solid particles obtained in the solution at a temperature required for the process to occur, with the result that the whole solution will spontaneously and rapidly break down and the concentration of the components needed for nickel-plating will diminish. And although stabilizing agents are introduced into the nickel-plating solution, solid particles arise in the solution, causing a spontaneous breakdown of the solution, so that said impurities have to be continuously or periodically removed.

There exists another known method for chemical nickel-plating (cf. U.S. Pat. No. 3,325,297) whereby the working solution is repeatedly used, with reagents restoring the concentration of the components in the solution and its acidity being added thereto and the particles of solid impurities being subsequently removed from the solution. The method is realized by use of a rather cumbersome installation comprising frame-mounted vessels disposed at a distance one from the other. One said vessel is filled with a prepared and preheated solution wherein the chemical process of nickel-plating takes place.

From said vessel the solution is supplied by gravity to the other vessel disposed below the former one, or, if this is not the case, the solution from the first vessel is pumped to the other one. On its way from one vessel to the other, the solution is cooled to a temperature not exceeding 40° C. either by being passed through tubular cooler or else by evaporation of water vapour under vacuum. Said second vessel is equipped with means for supplying reagents restoring the concentration of its components and its acidity into the cooled solution.

The latter vessel's design enables concentration of the particles of solid impurities which arise in the course of the reaction and form a sediment to be removed from the vessel.

Then the sedimenthic solution is pumped back to the first vessel, being heated on the way in a heat exchanger to a preset temperature.

However, realization of said method on the installation described has some difficulties. For one thing, the process consumes a lot of energy needed for frequent or continuous heating and cooling of large masses as the latter are transported by pumping over considerable distances.

Secondly, the stability of the solution is impaired as a result of its being moved about, and temperature variations.

The installation realizing said method comprises numerous auxiliary assemblies and vessels interconnected by a system of pipes at any time containing a large quantity of the solution which takes no direct part in the nickel-plating process. Since the nickel-plating solution is highly aggressive toward many materials and is also very unstable, the installation is difficult to manufacture and unreliable to operate.

It is an object of the present invention to obviate the foregoing disadvantages.

The present invention contemplates providing a method for chemically nickel-plating parts having a catalytic surface as well as an installation embodying said method such that the process could be made more economically efficient through lower nickel losses, reduced quantities of the working solution, reduced consumption of the reagents and minimized energy consumption for the heating and cooling of the solution-part of the equipment for the transportation of large quantities of the solution could be dispensed with, making it possible to minimize the size of the installation.

Accordingly, there is provided a method for chemical nickel-plating parts having a catalytic surface, which comprises preparing a solution containing a nickel salt, a hypophosphite, a complexing agent, a buffer dopant, an accelerator and a stabilizer; heating the solution to a temperature higher than 60° C. but lower than the boiling point thereof; immersing the parts to be nickel-plated into said solution; keeping same therein for as long as it takes to produce a nickel layer of desired thickness; and withdrawing the nickel-plated parts from the solution; as well as adding to the solution components restoring the concentration thereof; introducing an alkalizing reagent into the solution cooled to a temperature below 45° C. but above the freezing point of the solution; and concentrating in the solution the particles of solid impurities arising therein in the course of nickel-plating, whereby, in accordance with the invention, in the course of nickel-plating the upper layer of the solution is heated to the temperature indicated and the components restoring the concentration thereof are added thereto, whereas the lower layer of the solution is simultaneously cooled to the temperature indicated and the reagent restoring the acidity thereof is added thereto.

It is a cardinal object of the present invention to provide a method for chemical nickel-plating of parts having a catalytic surface which would be economically more efficient than the prior art methods, to be achieved through reduced energy consumption for the heating and cooling of reduced quantities of the solution and for the transportation thereof.

Another, and no less important, object of the invention consists in the provision of an installation realizing the foregoing method, which is more compact than the known installations of a similar kind and would enable the solution to be restored to a required condition during the course of nickel-plating.

These and other objects are attained in a method for chemical nickel-plating parts having a catalytic surface, which includes the steps of preparing a solution containing a nickel salt, a hypophosphite, a complexing agent, a buffer dopant, an accelerator and a stabilizer; heating the solution to a temperature higher than 60° C. but lower than the boiling point thereof; immersing the parts to be nickel-plated in said solution; keeping same therein for as long as it takes to produce a nickel layer of desired thickness; and with drawing the nickel-plated parts from the solution; as well as adding to the solution reagents restoring the concentration thereof; introducing an alkalizing reagent into the solution cooled to a temperature below 45° C. but above the freezing point thereof; and concentrating in the solution the particles of solid impurities arising therein in the course of the nickel-plating process, whereby, in accordance with the invention, in the course of the nickel-plating process the upper layer of the solution is heated to the temperature indicated and the components restoring the concentration thereof are added thereto, whereas the lower layer of the solution is simultaneously cooled to the temperature indicated and the reagent restoring the acidity thereof is added thereto.

Since the upper layer of the solution is heated while the lower layer thereof is cooled, temperature zones arise in the solution, making the nickel-plating process possible and simultaneously providing for the correction of the solution.

This feature, in turn, permits dispensing with two solutions and using only one made up of two layers, a heated one and a cooled one, concentration-restoring reagents being supplied into the former and a pH-restoring reagent into the latter. With the quantity of the nickel-plating solution thus reduced, it is possible to cut down on the energy consumption for the heating, cooling and transporting of the solution, reduce the amount of the reagents supplied into the solution, thereby cutting down on their losses, and also monitor the process more effectively.

The proposed method is desirably realized by use of an acidic aqueous solution containing a nickel salt in the form of nickel sulphate having a concentration of 25 to 30 g/lit, a hypophosphite in the form of sodium hypophosphite having a concentration of 15 to 20 g/lit, a complexing agent in the form of lactic acid having a concentration of 35 to 40 g/lit, a buffer and accelerating dopant in the form of boric acid having a concentration of 8 to 12 g/lit, and a stabilizer in the form of thiourea having a concentration of 0.0005 to 0.0008 g/lit.

The solution of the foregoing composition contains optimal quantities of the components, and the boric acid present therein in the amount specified stabilizes the rate of nickel deposition on the surface of parts being nickel-plated.

The object of the invention is attained in an installation which comprises two frame-mounted communicating vessels for the solution employed in the chemical nickel-plating process, one of said vessels being adapted to have the particles of solid impurities arising in the solution during the course of nickel-plating concentrated therein, an arrangement for heating and cooling the solution, and a device for feeding into the solution, reagents restoring the concentration and acidity thereof, wherein, in accordance with the invention, the vessel adapted to have the particles of solid impurities concentrated therein is provided with an arrangement for cooling the solution and communicates with a device for feeding an acidity-restoring reagent, and that atop said vessel there is mounted the other vessel formed as a tube and provided with an arrangement for heating the solution and communicating with a device for feeding thereinto concentration-restoring reagents.

The foregoing configuration of the installation and the shape of the vessels as well as the arrangement of the means for heating and cooling the solution and correcting its concentration and acidity add up to a compact installation reliable in operation and convenient to maintain. Said installation permits effecting the nickel-plating process and simultaneously correcting the solution.

The device for feeding the reagent restoring the acidity of the solution is desirably provided with a pipe inserted into the vessel which is adapted to have the particles of solid impurities concentrated therein and to cool the solution through a discharge opening formed in the bottom of said vessel, the free end of the pipe being disposed level with the junction of the vessels.

Such a position of the pipe for feeding the reagent restoring the acidity of the solution permits maintaining the acidity of the solution in the nickel-plating zone at a preset level and reduces the rate of formation of solid particles of nickel hyroxide. Said position of the pipe in the median zone of the solution volume between the heated and cooled layers thereof offers an additional advantage in that it conduces to a uniform distribution of the reagent about the entire volume of the solution, with the convective flows present in the solution.

A heat-insulation layer may be provided between the vessels at the junction thereof, preventing heat transfer from the heated upper vessel to the cooled lower one and thus cutting down on undesirable heat losses.

The invention will be further understood from the following description of an exemplary embodiment thereof taken in conjunction with the accompanying drawings, wherein.

Figure 2:
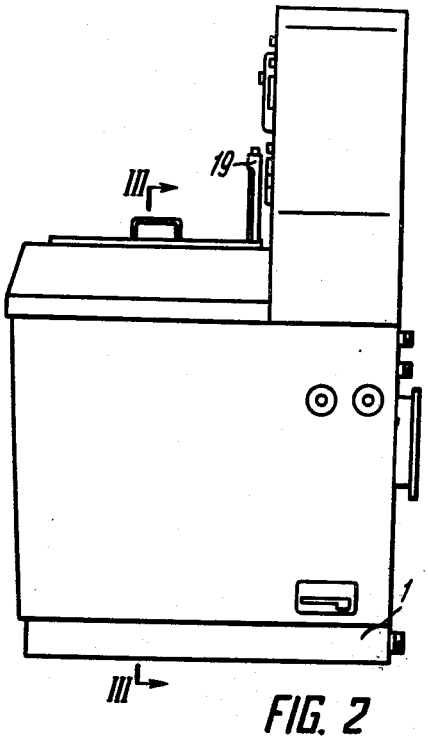
FIG. 2 is a side elevation of an installation, in accordance with the invention.
Figure 1:
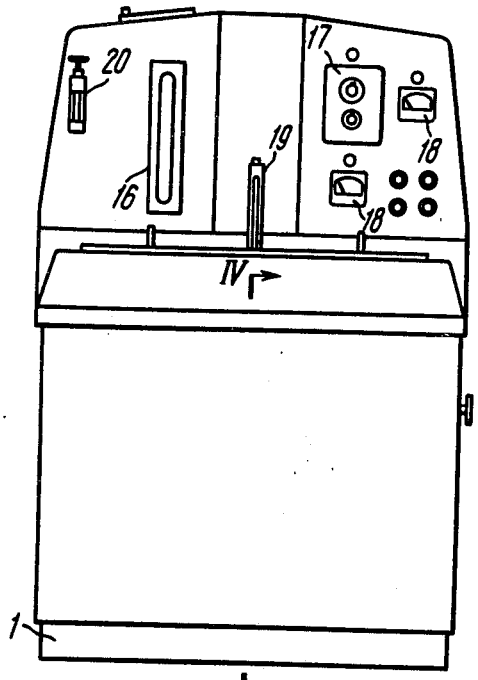
FIG. 1 is a front elevation of an installation, in accordance with the invention.

Referring now to the drawings, the proposed installation comprises a frame 1 (FIGS. 1 and 2) whereon a bath is mounted for the chemical nickel-plating solution, said bath comprising a vessel 2 (FIGS. 3 and 4) and a tubular vessel 3 disposed atop the vessel 2 and communicating therewith.

At the junction of said vessels 2 and 3 there is provided a heat-insulation layer 4.

The lower vessel 2 is narrowed as against the upper vessel 3 and has a funnel-shaped bottom. Such a design adapts the vessel 2 to have the particles of solid impurities arising in the course of chemical nickel-plating of parts with a catalytic surface concentrated therein.

The lower vessel 2 is provided with an arrangement 5 for cooling the solution contained therein, actually the lower layer of the solution contained in the bath composed of said two vessels 2 and 3.

The arrangement 5 for cooling the solution in the vessel 2 has double walls defining a space for the coolant supplied via a conduit 6 and discharged via a conduit 7. To remove the particles of solid impurities from the solution, there is provided a conduit 8 connected to the lower vessel 2 at a discharge opening 9 (FIG. 4) formed in the bottom of the vessel 2, said conduit 8 communicating with a collector (not shown in the drawing).

For supplying the reagent restoring the acidity of the solution, there is provided a device 10 comprising a pipe inserted through the discharge opening 9 into the vessel 2 so that the free end of the pipe is disposed level with the junction of the vessels 2 and 3. This pipe is connected by a conduit 11 (FIG. 3) with a reagent reservoir (not shown in the drawing).

Figure 4:
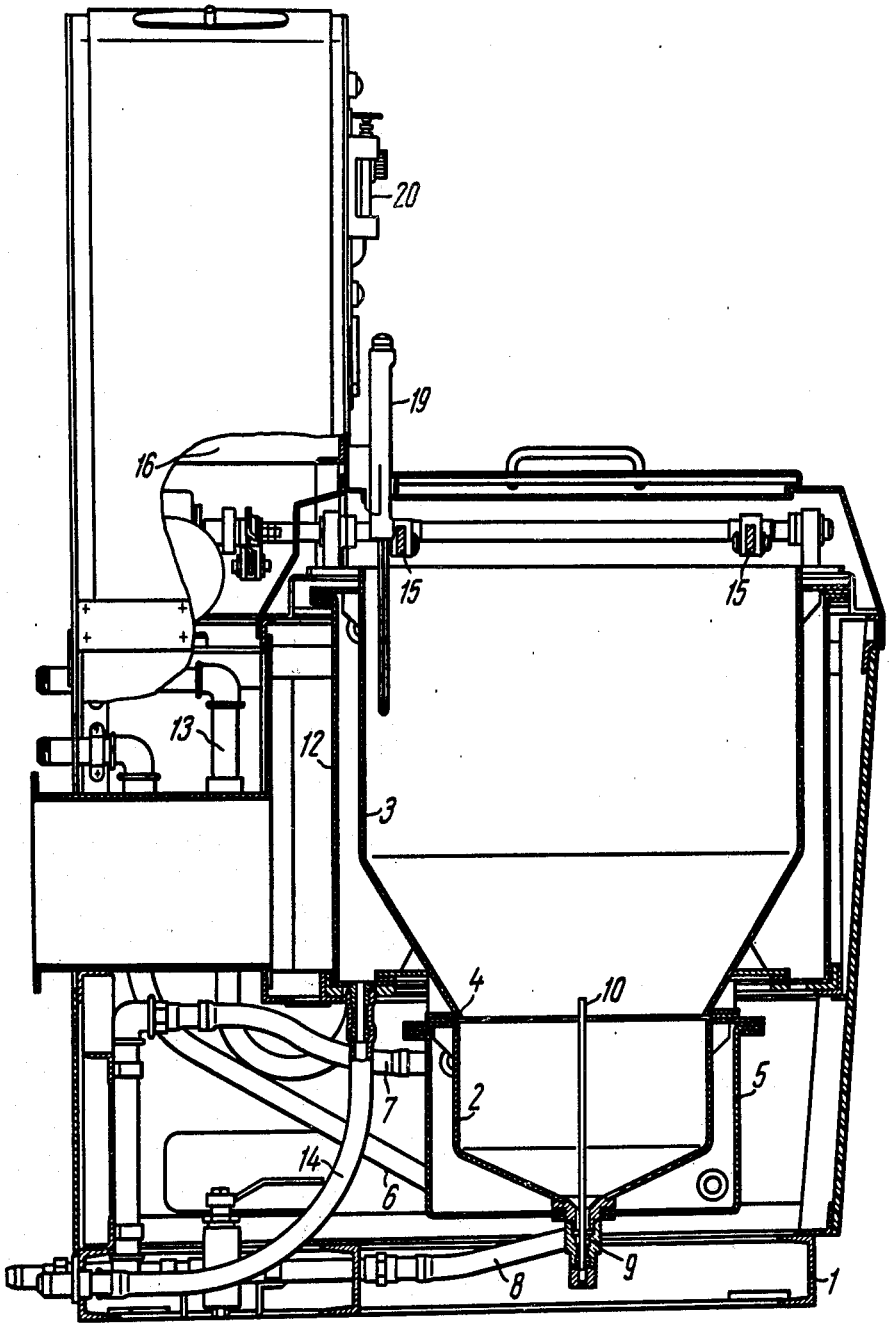
FIG. 4 is a sectional view, partially in cut-away, taken on the line IV—IV in FIG. 1.

The upper vessel 3 is intended to have the parts to be nickel-plated (not shown in the drawing) immersed therein, It is provided with an arrangement 12 for heating the solution contained therein. To this end, the arrangement 12 has double walls defining a cavity wherethrough the heating agent, e.g. steam, may pass. To supply the heating agent into said cavity, there is provided a conduit 13; while to discharge the heating agent, there is provided a conduit 14 (FIG. 4).

Above the upper vessel 3 there are mounted rods 15 (FIG. 3) whereby the parts being nickel-plated may be suspended. To supply reagents restoring the concentration of the solution into the upper vessel 3, there is provided a device 16 (FIG. 4) comprising a level-graduated reagent tank and conduits (not shown in the drawing).

Mounted on the front panel of the installation are a timer 17 (FIG. 3), ammeters 18, a thermometer 19 and a rotameter 20, needed for monitoring the process and controlling the installation.

The installation of this invention operates as follows.

To realize the proposed method of chemical nickel-plating parts having a catalytic surface, an acidic aqueous solution is prepared having the following composition, g/lit:

- a nickel salt in the form of nickel sulphate, 25 to 30;
- a hypophosphite in the form of sodium hypophosphite, 15 to 20;
- a complexing agent in the form of lactic acid, 35 to 40;
- a buffer and accelerating dopant in the form of boric acid, 8 to 12; and
- a stabilizer in the form of thiourea, 0.0005 to 0.0008.

Figure 3:
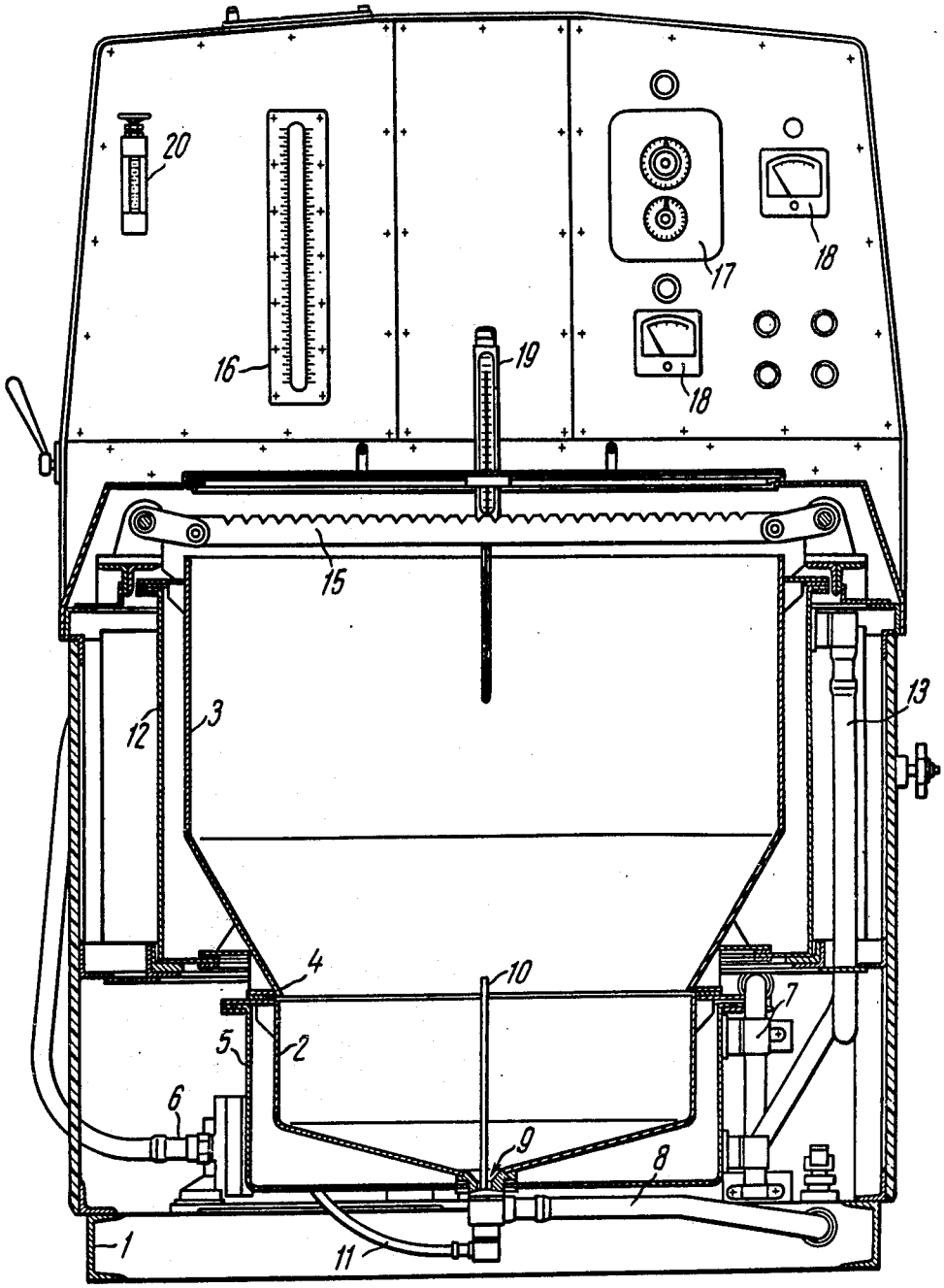
FIG. 3 is a sectional view taken on the line III—III in FIG. 2.

The thus prepared solution is poured into the bath made up of the vessels 2 and 3 (FIGS. 3 and 4). Then steam is supplied into the cavity of the arrangement 12, while cooling water at a temperature of from 10 to 20° C. is supplied into the cavity of the arrangement 5.

The upper layer of the solution is consequently heated while the lower one is cooled. The portion of the solution present in the vessel 3 is heated to a temperature above 60° C. but below the boiling point of the solution, e.g. to 88–92° C. When the thermometer 19 reads a preset temperature, the parts to be nickel-plated which are presuspended by the rods 15 are immersed in the solution. The parts being nickel-plated are kept in the solution for as long as it takes to build up thereon a nickel layer of desired thickness, whereupon they are withdrawn from the solution.

Simultaneously the solution is cooled from below so that the lower layer thereof drops to a temperature below 45° C. but above the freezing point of the solution. This task is feasible owing to the fact that the lower compartment of the bath (the vessel 2) has a relatively small capacity.

As the nickel layer on the surface of the parts grows in thickness, the concentration of the solution varies, its acidity rises and solid particles form therein.

For continuous correction of the solution during the course of nickel-plating, a reagent restoring the acidity of the solution is supplied into the vessel 2 via the pipe of the device 10, while reagents restoring the concentration of the nickel-plating solution are simultaneously supplied into the vessel 3 from the tank of the device 16.

The particles of solid impurities arising in the solution during the course of the nickel-plating process continuously settle by gravity to the bottom of the lower vessel 2, and thus have no adverse effect on the chemical nickel-plating process. The settled particles of solid impurities are periodically discharged via the conduit 8 into the collector (not shown in the drawing).

Tests have demonstrated the reliability of the installation and the possibility of correcting the solution without interrupting the nickel-plating process. As shown by measurements in a bath 750 mm deep, in the upper portion of the bath the temperature of the solution was 90°±2° C., while in the lower portion of the bath it was between 35 and 40° C.

At a charge density of 1.5 sq.dm/lit and a pH of from 4.6 to 4.8, the nickel-plating rate was 18 to 21 microns per hour throughout the entire period of utilization of the solution, i.e. until the concentration of sodium hypophosphite therein rose to 200 to 225 g/lit.

During that time 1 liter of the solution yielded 35 g of nickel. The nickel layer deposited on the parts contained between 7 and 10 percent phosphorus by weight.

What is claimed is:

1. A method for chemical nickel plating a substrate having a catalytic surface which comprises: immersing said substrate in a vessel whose inner surface is non-catalytic and contains an aqueous solution of a nickel salt, a hypophospnite, a complexing agent, a buffer, an accelerator and a stabilizer; wherein said vessel comprises a lower zone cooled to a temperature below 45° C. but above the freezing point of said solution, and simultaneously, an upper zone heated to a temperature above 60° C. but lower than the boiling point of said solution; and wherein the volume of the lower zone is less than the volume of the upper zone; said substrate being immersed and plated in said heated upper zone.

2. A method as set forth in claim 1, whereby said solution contains from 25 to 30 g/lit of nickel sulfate as the nickel salt, 15 to 20 g/lit of sodium hypophosphite as the hypophospite, 35 to 40 g/lit of lactic acid as the complexing agent, 8 to 12 g/lit of boric acid as the buffer and accelerator, and 0.0005 to 0.0008 g/lit of thiourea as the stabilizer.

3. The method of claim 1 wherein said vessel is jacketed and insulated to separately heat the upper zone and cool the lower zone.

* * * * *